United States Patent [19]

Mikami et al.

[11] Patent Number: 4,717,638

[45] Date of Patent: Jan. 5, 1988

[54] PAPER FOR ELECTROSTATOGRAPHY USING ENCAPSULATED TONER

[75] Inventors: Takeshi Mikami; Masakazu Maekawa, both of Fujinomiya, Japan

[73] Assignee: Fuji Photo Film Co., Ltd., Kanagawa, Japan

[21] Appl. No.: 853,382

[22] Filed: Apr. 16, 1986

Related U.S. Application Data

[63] Continuation of Ser. No. 616,531, Jun. 1, 1984, abandoned.

[30] Foreign Application Priority Data

Jun. 3, 1983 [JP] Japan ..... 58-99238

[51] Int. Cl.[4] ..... G03G 13/22

[52] U.S. Cl. ..... 430/98; 430/138

[58] Field of Search ..... 430/138, 98; 428/338, 428/409; 427/362

[56] References Cited

U.S. PATENT DOCUMENTS 2,940,847 6/1960 Kaprelian ..... 430/138
3,911,180 10/1975 Ozaki et al. ..... 427/362
4,420,528 12/1983 Okiyama ..... 428/338

FOREIGN PATENT DOCUMENTS 80229 7/1978 Japan .

*Primary Examiner*—John L. Goodrow
*Attorney, Agent, or Firm*—Jules E. Goldberg

[57] ABSTRACT

A paper for electrostatography using an encapsulated toner which comprises a core and a shell enclosing the core, characterized in that the optically measured surface roughness value (Rp value) is not more than 3.2 μm.

6 Claims, No Drawings

PAPER FOR ELECTROSTATOGRAPHY USING ENCAPSULATED TONER

This is a continuation of application Ser. No. 616,531, filed June 1, 1984 now abandoned.

BACKGROUND OF THE INVENTION

1. Field of the Invention

This invention relates to a paper for electrostatography using an encapsulated toner, and more particularly to a paper for receiving on its surface a visible image of an encapsulated toner, such as a paper employable in copying machine, printing machine or line printer utilizing electrostatography.

2. Description of Prior Arts

There is known an electrostatography which comprises a stage of developing a tone electrostatic latent image contained on a photoconductive or dielectric surface with a toner material containing a colorant and a fixing aid (i.e., binder) to produce a visible toner image, and a subsequent stage of transferring and fixing the visible toner image onto a surface of a substrate (i.e., support medium) such as a paper.

The development of the latent image to produce a visible toner image is carried out by the use of either a developing agent consisting essentially of a combination of a toner with carrier particles, or a developing agent consisting essentially of a toner only. The developing process utilizing the combination of a toner with carrier particles is named "two component developing process", while the developing process utilizing only a toner is named "one component developing process".

The toner image formed on the latent image is then transferred onto a surface of a substrate and fixed thereto. The process for fixing the toner image to the substrate can be done through one of three fixing processes, that is, a heat fixing process (fusion process), a solvent fixing process and a pressure fixing process.

The pressure fixing process which involves fixing the toner onto the surface of a substrate under application of pressure thereto is described, for instance, in U.S. Pat. No. 3,269,526. The pressure fixing process involving the use of neither a heating procedure nor a solvent produces no such troubles as inherently attached to either the heat fixing process or the solvent fixing process. Moreover, the pressure fixing process can be employed in conjunction with a high speed automatic copying and duplicating process, and the access time is very short in the pressure fixing process. Accordingly, the pressure fixing process is considered to be an advantageous fixing process inherently having a variety of preferable features.

However, the pressure fixing process also has certain inadvantageous features. For instance, the pressure fixing process generally shows poorer toner fixing property than the heat fixing process does, whereby the toner image fixed onto a paper is apt to rub off easily. Further, the pressure fixing process requires very high pressure for performing the fixing operation, and such high pressure tends to break the cellulose fibers of the substrate such as paper and also produces unsatisfactorily glossy surface on the substrate. Moreover, the pressing roller requires to have relatively greater size, because the roller necessarily imparts very high pressure to the toner image placed on the substrate. Accordingly, a reduction of the size of a copying machine cannot exceed a certain limit defined by the size of a pressing roller.

There has been previously proposed an encapsulated toner which comprises toner particles enclosed with microcapsules, so as to overcome the above-described disadvantageous features of the pressure fixing process. The encapsulated toner is generally prepared by enclosing a core material (containing a colorant such as carbon black) with a shell which is rupturable by the application of pressure in the developing stage. Thus prepared encapsulated toner has various advantageous features; for instance, fixing of the encapsulated toner does not require very high pressure but the toner fixing property is high. Accordingly, the encapsulated toner is viewed as suitable for the use in the pressure fixing process. However, a copying operation using encapsulated toners proposed up to now appear unsatisfactory in giving a visible toner image of high quality. This unsatisfactory result arises from some unsatisfactory characteristics of the toner as well as from certain unfitness of a paper substrate employed.

A paper employed as a substrate for receiving the visible image of encapsulated toner is required to show the following characteristics: the toner image transferred on the paper can be easily and firmly fixed thereonto; the paper is substantially free from troubles possibly occurring in the paper supply system of the coyping machine, such as paper clogging, double supply, misfeeding, and troubles in the course of introducing the paper into a tray or sorter; the paper retains the fixed toner image with high quality; and the paper is satisfactory in the appearance, for instance, with respect to curling, hue, crease, and dimensional accuracy. However, the papers heretofore employed in the electrostatography using encapsulated toners are not satisfactory in certain features of the above-mentioned characteristics.

SUMMARY OF THE INVENTION

Accordingly, it is an object of the present invention to provide a paper for electrostatography using an encapsulated toner which is improved particularly in the toner fixing property. The toner fixing property means a property of retaining the toner image under adhesion to the paper. More in detail, the fixing of the encapsulated toner is performed by passing a paper carrying the toner image thereon through hard metal rollers to apply pressure onto the paper, whereby the encapsulated toner is ruptured thereon and fixed via an adhesive material (binder) having been enclosed in the toner. The heretofore employed paper for electrostatography using an encapsulated toner is not sufficiently satisfactory in the toner fixing property, and the conventional toner fixed onto the paper is liable to easily rub off with a finger or other material such as a paper to stain a portion other than the toner image portion. Such insufficient toner fixing property of the conventionally employed paper is one reason to disturb practical use of the encapsulated toner in the pressure fixing process.

Another object of the present invention is to provid a paper for electrostatography using an encapsulated toner which is improved in the off-setting, in addition to the improvement of the toner fixing property. The off-setting means a phenomenon in which a portion of a core material and shell of a toner ruptured by the applciation of pressure, for instance, by passing the paper carrying the toner image thereon through hard metal rollers adheres to the surface of the roller to stain the roller surface. Such phenomenon to stain the roller surface is another reason to disturb practical use of the encapsulated toner in the pressure fixing process.

A further object of the invention is to provide a paper for electrostatography which is improved in the toner fixing property and the off-setting, is capable of retaining a fixed toner image with high quatity, shows satisfactory appearance, and is easily and smoothly transferred within a copying machine.

It has been now discovered that surface smoothness or roughness of the paper employed in electrostatography using an encapsulated toner greatly influences the pressure fixing property of an encapsulated toner transferred thereon. If a paper having rather high roughness is employed as the substrate for electrostatography, not a few toner particles received in the concave portions of the paper possibly remain unruptured on the paper after application of pressure. Therefore, such unruptured toner particles are still simply in contact with the paper via no adhesive material (binder) even after the application of pressure, and accordingly they easily drop out of the paper. As a result of further study, the present inventors have discovered that such poor toner fixing property is improved using a paper having an extremely smooth surface.

Accordingly, the present invention provides a paper for electrostatography using an encapsulated toner which comprises a core and a shell enclosing the core, characterized in that the optically measured surface roughness value (Rp value) is not more than 3.2 μm, preferably not more than 2.9 μm.

The fixing property of an encapsulated toner in electrostatography is remarkably improved by the use of the paper having an extremely smooth surface according to the present invention. An improvement is also introduced in the off-setting property. Moreover, the paper of the present invention can be very smoothly transferred in a copying machine, and its appearance is satisfactory. For these reasons, the paper of the present invention is very advantageously employed as a substrate for receiving a toner image and retaining the fixed toner image in electrostatography.

DETAILED DESCRIPTION OF THE INVENTION

The surface roughness value (Rp value) of a paper is a value indicating a mean depth of concave portions of a surface of the paper which is optically determined through a prism placed on the paper surface under pressure. The principle of the determination is described by Shinpei Inamoto in a paper entitled "Method of Determination of Printing Smoothness of Paper Based Mainly on Optical Contact-Measuring Process" (Report of Ministry of Finance, Printing Bureau Laboratory, Vol. 29, No. 9, pp. 615–622 (September of 1977)). The Rp value can be determined, for instance, by means of a dynamic printing smoothness measuring apparatus available from Toyo Seiki Seisakusho Co. Ltd., Japan.

The optical roughness value (i.e., Rp value) defined in the present invention is a value determined at one minute after application of pressure of 100 kg/cm$^2$ to the prism placed on the paper surface.

The paper of the invention is preferably prepared from a pulp beaten to Canadian Freeness (defined in JIS P 8121) 300–750 cc and adjusted to have a long fiber ratio of 5–70%, preferably 10–65% (total amount of 24 mesh (710 μm) unfiltered fibers and 42 mesh (350 μm) unfiltered fibers per amount of whole fibers). The paper preferably has a weight of 35–80 g/m$^2$ and, if necessary, the surface thereof can be coated with a white pigment in an amount of 0.5–10 g/m$^2$, preferably 2–10 g/m$^2$ for one surface. The white pigment preferably has a whiteness of not less than 60%, more preferably not less than 65%, and an oil absorption capacity of not less than 75 ml/100 g (value according to JIS K-5101).

The paper of the present invention can be prepared by processing a fibrous sheet of water content of not less than 3%, preferably not less than 5%, on machine calender, super calender, thermo-planisher, gloss calender.

More in detail, the paper of the invention can be prepared from a wood pulp such as NBKP, LBKP, NBSP or LBSP treated under the above-mentioned conditions. A synthetic pulp may be employed in conjunction with the wood pulp to increase the void ratio of the resulting paper. The paper can contain fillers such as clay, talc, calcium carbonate, and urea resin fine particles; sizing agents such as rosin, aluminum succinate, alkylketene dimer and petroleum resin; and fixing agents such as barium sulfate and cationic polymer. Moreover, a polymer adhesive such as starch, polyvinyl alcohol or SBR latex can be coated on the paper by size-press.

The paper of the invention can contain no sizing agent showing Stöckigt sizing degree 0 sec., but perferably is a sized paper showing Cobb size degree of 15–25 g/m$^2$.

Moreover, the paper can be prepared by processing a fibrous sheet in Yankee dryer to press and dry it and then processing the resulting sheet on super calender, machine calender or gloss calender, whereby further decreasing the optical surface roughness value (Rp value).

On the surface of the paper, a coating layer (i.e., inorganic pigment layer) can be provided under the aforementioned conditions, if necessary. Examples of the pigment include china clay, fired china clay, calcium carbonate, talc, agalmatolite, diatomaceous earth, aluminum hydroxide, magnesium hydroxide, magnesium carbonate, titanium dioxide, barium carbonate, and barium sulfate. As described hereinbefore, the inorganic pigment preferably has a whiteness of not less than 60%, more preferably not less than 65%, and an oil absorption capacity of not less than 75 ml/100 g (value determined according to JIS K-5101). Further, the inorganic pigment can be so processed on it surface to increase the whiteness and oil absorption capacity.

The inorganic pigment layer may contain a binder such as a water-soluble polymer, for instance, polyvinyl alcohol, starch derivative, casein, gelatin, or hydroxyethylcellulose, or a hydrophobic polymer emulsion, for instance, styrene-butadiene rubber latex or acrylic resin emulsion.

The encapsulated toner mentioned in the present invention is a toner in the form of microcapsules which comprise aa core (including colorant and binder) and a shell enclosing the core therein, the shell being rupturable under pressure. The encapsulated toner employable in the electrostatography utilizing the paper of the invention preferably has been particle size of 5–30 μm, more preferably 10–20 μm.

There is already known a process for the preparation of microcapsule which comprises forming a shell around a core material containing colorant and binder. The encapsulated toner of the invention can be prepared by known processes. Examples of the known processes include an interfacial polymerization method, an inner polymerization method, a phase separation method, an outer polymerication method, a fusion-dispersion-cooling method, and a coacervation method.

The colorant contained in the core material produces a visible image from the latent image. The colorant generally is a dye or a pigment, but a certain agent providing no directly visible image such as fluorescent substance can be employed as the colorant, if desired.

The colorant is generally selected from a variety of dyes, pigments and the like employed generally in the conventional electrostatographic copying and duplicating process. Generally the colorant is a black toner or a chromatic toner. Examples of the black toner include carbon black. Examples of the chromatic toner include blue colorants such as copper phthalocyanine and a sulfonamide derivative dye; yellow colorants such as a benzidine derivative dye, that is generally called Diazo Yellow; and and red colorants such as Rhodamine B Lake, that is, a double salt of xanthine dye with phosphorus wolframate and molybdate, Carmine 6B belonging to Azo pigment, and a quinacridone derivative.

The binder contained in the core material serves for keeping the colorant, etc. under dispersion in the core, and further serves as adhesion aid for the colorant to adhere to a paper so as to fix the visible toner image onto the paper.

The binder employable for the above-mentioned purpose preferably is a high-boiling point solvent such as a solvent having a boiling point of not lower than 180° C. or a polymer.

Examples of the high-boiling point solevnt include phthalic acid esters, phosphoric acid esters, citric acid esters, benzoic acid esters, aliphatic acid esters, alkylnaphthalenes, alkyldiphenyl esthers, higher fatty acid amides, aromatic sulfonic acid amides, trimellitic acid esters, and diarylalkanes.

Examples of the polymer include polyolefins, olefin copolymers, polystyrenes, styrene - butadiene copolymer, epoxy resings, polyesters, natural or synthetic rubbers, poly(vinylpyrrolidone), polyamides, cumarone-indene copolymer, methyl vinyl ether-maleic anhydride copolymer, maleic acid-modified phenol resin, phenol-modified terpene resin, silicone resin, epoxy-modified phenol resin, amino resin, polyurethane elastomer, polyurea elastomer, homopolymer and copolymer of acrylic acid ester, homopolymer and copolymer of methacrylic acid ester, acrylic acid-long chain alkyl methacrylate copolymer oligomer, poly(vinyl acetate), and poly(vinyl chloride).

The binder preferably comprises a combination of the high-boiling point solvent and the polymer.

More preferably, the binder contains, in addition to the high-boiling point solvent and the polymer, an organic liquid having a boiling point of 100°–250° C. and substantially incapable of dissolving or swelling the coexisting polymer. Examples of the above-mentioned organic liquid include saturated aliphatic hydrocarbons and organic liquid mixture containing the saturated aliphatic hydrocarbons as main components.

The core material may contain other components than the colorant and binder. Examples of the other components include magnetizable particles appropriately employable in the one component developing system.

There is no specific limitation on material of the shell of the encapsulated toner, as far as the shell is rupturable under pressure. Examples of the shell material include synthetic resins such as polyurethane, polyurea, polyamide, polyester, polysulfonamide, epoxy resin, polysulfanate, polycarbonate, polystyrene, poly-p-chlorostyrene, styrene-butadiene copolymer, styrene-acrylic acid copolymer, styrene-acrylic ester copolymer, styrene-methacrylic acid copolymer, styrene-methacrylic ester copolymer, styrene-maleic anhydride copolymer, styrene-vinyl acetate copolymer, polyvinyltoluene, polyacrylic acid ester, polymethacrylic acid ester, xylene resin, methylvinyl ether-maleic anhydride resin, vinylbutyral resin, polyvinyl alcohol, and polyvinylpirrolidone.

Moreover, the shell of the encapsulated toner can be composed of a complex layer. For instance, the shell can comprise two or more polymers selected from the group consisting of a polyurethane resin, a polyurea resin and a polyamide resin.

The present invention will be illustrated by the following examples which are by no means construed to introduce any restriction into the invention.

Preparation of Encapsulated Toner

A dispersion of 3 g. of carbon black and 15 g. of magnetite in 27 g. of diisopropylnaphthalene prepared in a mortar was mixed with 10 g. of a mixture of acetone and methylene chloride (1:3) to prepare a primary liquid. Separately, 4 g. of an adduct of hexamethylene diisocyanate and hexanetriol (3:1 molar ratio addition product) was added to the primary liquid to prepare a secondry liquid. The mixing procedure was carried out at a temperature of not higher than 25° C.

To an aqueous solution of 3 g. of gum arabic in 60 ml of water kept at 20° C. was portionwise added under vigorous stirring the secondary liquid to produce an oil-in-water emulsion containing oily droplets having diameter of 5–15 μm. The formation of the emulsion was carried out at a temperature of not higher than 20° C. by chilling the outer surface of the reaction vessel. The stirring was further continued after the production of emulsion. To the emulsion was added 100 ml. of water (kept at 40° C.). The resulting mixture was then slowly heated up to 90° C. over 30 min. and kept for 20 min. at the temperature to perform the encapsulating reaction.

Thus obtained aqueous microcapsule dispersion was subjected to centrifugal separation (5,000 rpm) to separate the microcapsules from water. The separated microcapsules were then dispersed in water to prepare 30 wt.% aqueous dispersion. The aqueous microcapsule dispersion was then spray dried to give dry powdery encapsulated toner.

EXAMPLES 1–4 AND COMPARISON EXAMPLES 1–2

A latent image prepared by the conventional electrostatography was developed using the above-obtained encapsulated toner to form a toner image, and the toner image was then transferred on a paper to produce a visible toner image thereon. The toner image was fixed to the paper by means of a pressing roller at a pressure of 350 kg/cm$^2$. There was produced a very sharp toner image.

The fixing property of the toner image on the paper was evaluated by the following procedure.

The paper onto which the toner image was fixed was allowed to stand for 10 min. at room temperature after the application of pressure, and subsequently a certain portion of the toner image was rubbed with a finger repeatedly as many as five times. The conditions of the rubbed portion of the toner image, such as drop-out of the toner and stain on the white ground poriton were observed. The results are set forth in Table 1, in which the judgement is expressed in accordance with the following criteria:

(1) Neither drop-out of the toner nor toner stain on the white ground portion was observed —Excellent;

(2) Either a little drop-out of the toner or a little toner stain on the white ground portion was observed—Good; and (3) Most of the rubbed portion was dropped out, and noticeable toner stain was observed on the white ground portion—Bad.

TABLE 1

| | Conditions of Paper | | | Toner |
|---|---|---|---|---|
| | Weight ($g/m^2$) | Thickness ($\mu m$) | Optical Surface Roughness (Rp) | Fixing Property |
| Example | | | | |
| 1 | 50.1 | 53 | 2.97 | Good |
| 2 | 52.1 | 70 | 1.49 | Excellent |
| 3 | 52.3 | 60 | 1.37 | Excellent |
| 4 | 47.5 | 53 | 2.00 | Excellent |
| Comparison Example | | | | |
| 1 | 50.3 | 63 | 3.50 | Bad |

TABLE 1-continued

| | Conditions of Paper | | | Toner |
|---|---|---|---|---|
| | Weight ($g/m^2$) | Thickness ($\mu m$) | Optical Surface Roughness (Rp) | Fixing Property |
| 2 | 50.4 | 65 | 4.00 | Bad |

Remark: The papers employed in Examples and Comparison Examples were as follows:
Example 1: Wood free paper (high quality paper) processed on super calender
Example 2: Pure white machine glazed paper
Example 3: Pure white machine glazed paper processed on super calender
Example 4: Light-weight coated paper
Comparison Example 1: Wood free paper (high quality paper)
Comparison Example 2: Medium quality paper

We claim:

1. In an electrostatographic process wherein an encapsulated toner which comprises a core and a shell enclosing the core is fixed on a substrate under pressure to form a toner image, the improvement which comprises the substrate for retaining the toner image under fixation being a sized fibrous paper sheet having a optically measured surface roughness value of not more than 3.2 $\mu m$.

2. The electrostatographic process as claimed in claim 1 in which said optically measured surface roughness value of the sized fibrous paper sheet is not more than 2.9 $\mu m$.

3. The electrostatographic process as claimed in claim 1 in which the fibers of the sized fibrous paper sheet are wood pulp.

4. The electrostatographic process as claimed in claim 2 in which the fibers of the sized fibrous paper sheet are wood pulp.

5. The electrostatographic process as claimed in claim 1 in which the sized fibrous paper sheet possesses a Cobb size degree of 15–25 $g/m^2$.

6. The electrostatographic process as claimed in claim 2 in which the sized fibrous paper sheet possesses a Cobb size degree of 15–25 $g/m^2$.

* * * * *